US011286071B2

(12) United States Patent
Rapparini

(10) Patent No.: US 11,286,071 B2
(45) Date of Patent: Mar. 29, 2022

(54) SYSTEM FOR MEASURING OUT AND CUTTING COMPACTED POWDERS

(71) Applicant: ICA SPA, Bologna (IT)

(72) Inventor: Gino Rapparini, Bologna (IT)

(73) Assignee: ICA S.P.A., Bologna (IT)

( * ) Notice: Subject to any disclaimer, the term of this patent is extended or adjusted under 35 U.S.C. 154(b) by 186 days.

(21) Appl. No.: 16/464,849

(22) PCT Filed: Dec. 4, 2017

(86) PCT No.: PCT/IB2017/057609
§ 371 (c)(1),
(2) Date: May 29, 2019

(87) PCT Pub. No.: WO2018/100563
PCT Pub. Date: Jun. 7, 2018

(65) Prior Publication Data

US 2019/0382148 A1 Dec. 19, 2019

(30) Foreign Application Priority Data

Dec. 2, 2016 (IT) ..... 102016000122873

(51) Int. Cl.
*B65B 31/04* (2006.01)
*B65B 1/12* (2006.01)
*B65B 9/20* (2012.01)

(52) U.S. Cl.
CPC ..... *B65B 31/045* (2013.01); *B65B 1/12* (2013.01); *B65B 9/20* (2013.01); *B65B 2220/06* (2013.01)

(58) Field of Classification Search
CPC .... B65B 1/12; B65B 1/24; B65B 1/28; B65B 9/20; B65B 31/045; B65B 37/10; B65B 2220/06
(Continued)

(56) References Cited

U.S. PATENT DOCUMENTS 1,520,669 A * 12/1924 Ziegner ..... B65B 1/12 222/311
1,546,360 A * 7/1925 Bates ..... B65B 1/34 53/451
(Continued)

FOREIGN PATENT DOCUMENTS

CA 895493 3/1972
CA 895493 A * 3/1972
(Continued)

OTHER PUBLICATIONS

International Search Report for corresponding International Application No. PCT/IB2017/057609, dated Feb. 5, 2018; 3 pages.

*Primary Examiner* — Thanh K Truong
*Assistant Examiner* — David G Shutty
(74) *Attorney, Agent, or Firm* — Fattibene and Fattibene LLC; Paul A. Fattibene

(57) ABSTRACT

A system and a method for packaging compacted powders are provided, wherein the system comprises a first tube (TC), wherein a screw conveyor (C) is positioned inside the first tube (TC) which is configured so as to rotate around an axis (ac) inside the first tube (TC) in order to convey the powders towards an outlet (UT) of the first tube (TC); the system (100) comprises a rotatable terminal (TI, TIC) in the proximity of the output (UT); the rotatable terminal (TI, TIC) comprises in its inside cutting means (F) which are configured so as to cut the compacted powders leaving the first tube (TC) when the rotatable terminal (TI) rotates, wherein the rotatable terminal (TI, TIC) is positioned so as to contact the end of the first tube (TC) which defines the output (UT).

11 Claims, 14 Drawing Sheets

(58) Field of Classification Search
USPC ..... 53/121, 433, 435, 451, 511, 513, 551
See application file for complete search history.

(56) References Cited

U.S. PATENT DOCUMENTS 2,002,420 A * 5/1935 Strosk ..... A47F 1/03 222/240
2,014,617 A * 9/1935 Fischer ..... B65B 37/10 222/56
2,432,373 A * 12/1947 Bleam ..... B65B 31/021 53/433
2,988,249 A * 6/1961 Wahl ..... B65B 37/10 222/404
3,040,490 A * 6/1962 Virta ..... B65B 1/28 53/434
3,191,642 A * 6/1965 Saito ..... G01G 21/00 141/128
3,703,796 A * 11/1972 Inoue ..... B65B 39/003 53/121
4,322,021 A * 3/1982 Olsson ..... B65G 65/463 198/531
4,407,108 A * 10/1983 Craig ..... B65B 1/32 141/83
4,633,923 A * 1/1987 Hinzmann ..... B65B 39/004 141/116
4,640,083 A * 2/1987 Takahashi ..... B65B 39/04 141/285
5,042,539 A * 8/1991 McGregor ..... B65B 37/00 141/114
5,438,396 A * 8/1995 Mawdesley ..... G03G 15/0865 222/DIG. 1
5,832,700 A * 11/1998 Kammler ..... B65B 1/46 53/502
6,102,088 A * 8/2000 Wegman ..... B65B 1/12 141/256
6,179,015 B1 * 1/2001 Kammler ..... B65B 9/20 141/4
6,470,921 B1 * 10/2002 McGregor ..... B65B 1/12 141/12
6,530,403 B2 * 3/2003 McGregor ..... B65B 1/12 141/263
6,640,845 B1 * 11/2003 Wegman ..... B65B 1/12 141/59
6,904,737 B2 * 6/2005 Engesser ..... B65B 1/12 53/238
7,011,292 B1 * 3/2006 Hill ..... B65B 39/003 137/601.11
7,614,205 B2 * 11/2009 Conti ..... B65B 29/025 53/559
7,793,669 B2 * 9/2010 Farano ..... A47L 15/4463 134/93
9,702,567 B2 * 7/2017 Owen ..... F24B 13/04
2008/0019659 A1 8/2008 Conti ..... 53/113
2011/0005172 A1 * 1/2011 Miyahara ..... B65B 29/028 53/455
2014/0238536 A1 * 8/2014 Kumakura ..... B65B 1/12 141/67
2019/0118981 A1 * 4/2019 Kuss ..... B65B 51/146
2019/0233140 A1 * 8/2019 Rapparini ..... B65B 1/26
2019/0382148 A1 * 12/2019 Rapparini ..... B65B 9/20

FOREIGN PATENT DOCUMENTS

DE 2020008011260 11/2008
EP 2765099 8/2014
JP S5913402 1/1984
JP 2002179009 6/2002
JP 2002179009 A * 6/2002
JP 2004276956 10/2004
JP 2004276956 A * 10/2004
JP 2008150048 7/2008
JP 2008150048 A * 7/2008
JP 2011251762 12/2011
JP 2011251762 A * 12/2011
WO WO 2006008624 1/2006

* cited by examiner

SYSTEM FOR MEASURING OUT AND CUTTING COMPACTED POWDERS

TECHNICAL FIELD

The present invention concerns the field of packaging of powders. In particular, the present invention relates to a system for measuring out and cutting compacted powders. Moreover, the present invention relates to a method for cutting compacted powders.

BACKGROUND

Packages containing powdered materials like, for example, flour are found on the market in extremely large quantities. Industrially, screw conveyors are used to convey the powdered material inside the package where it will be enclosed. The optimisation of the filling process of such packages is demanding since a powdered material has an amount of air inside it that thus increases the volume thereof and makes precise weighing thereof difficult.

In many cases, in feeding systems, it is important to remove the air from inside the product to be dosed. The removal of the air can indeed allow the reduction of the volume of the product (of the same weight) to be transported. Moreover, the removal of air from inside the product to be dosed can allow the organoleptic properties of the product to be kept for a longer period of time and therefore can increase the lifetime of the product by preventing, for example, oxidation process. Therefore, for this purpose, the food industry often uses deaerators, both horizontal and vertical. The deaeration process allows the elimination of the air incorporated in the powder and therefore allows packages with the same volume to become heavier. The operating principle is based on the continuous extraction of the air existing, under normal conditions, between the particles of product through the creation of vacuum inside the tube for conveying the powders inside the machine. Through such a technique, the problem of packaging for even very light and very volatile powders is thus solved. Such a solution does not however solve the problem of obtaining precise dosing. One of the main reasons concerns the fact that, since the powders are compacted, at the end of the rotation of the screw conveyor, a part of the compacted powders remains anchored at the outlet due to the high degree of compaction. Therefore, errors are generated in the dosage of the quantity of powders leaving the screw conveyor. In order to solve this problem, in the state of the art, it is proposed to limit the degree of compaction of the powders. However, this is not desirable because the advantages described above are limited by a high degree of compaction of the packaged powders.

Moreover, prior art document JP 2004 276956 A is known from the state of the art, which describes a method of partial removal of the compacted powders at the outlet of a tube in which a screw conveyor is positioned. This is because, as described in this document, the agglomeration of powders on the outer edge could result in an error in the dosage when this agglomerate falls into the package by gravity.

However, the system presented in this document does not solve the problem of accurately measuring the quantity of powders conveyed into the packages. One of the main reasons can be clearly seen in the figures, where it is clearly shown that there is a space between the outlet of the tube and the cutting means. This space, as described in this document, is necessary so as to prevent the cutting means from coming into contact with the outlet of the tube due to, for example, vibrations created during rotation.

Therefore, a strong disadvantageous consequence of this space D consists in having a loss of powders which will be conducted in a radial direction towards the outside through the space. This results in the impossibility of conveying the powders with extreme precision of dosage to the inside of the packages. Therefore, the system described in this document makes it only partially possible to solve the problem of dosing, avoiding only in part that large quantities of powders accumulated outside the opening of the tube may fall into the packages.

Therefore, in the light of what has been described above, the present invention addresses the problem of allowing packaging compacted powders with a high precision in the dosage of the product and, at the same time, with a high degree of compaction.

SUMMARY

The present invention is based on the idea of cutting out the powders leaving the dosing system, thus allow controlling the dosage of the product with high precision.

In the present invention, the terms "above", "below", "lower", and "upper", unless specified otherwise, refer to the condition of the various elements considering a section view of the final architecture of the packaging system in which the package occupies the lowest level.

According to an embodiment of the present invention, a system for packaging powders is provided comprising a first tube comprising a screw conveyor configured to rotate about an axis inside the first tube so as to convey the powders towards an outlet of the first tube; the system comprises a rotatable terminal close to the outlet of the first tube; the rotatable terminal internally comprises cutting means configured so as to cut the compacted powders exiting from the first tube when the rotatable terminal rotates, wherein the rotatable terminal is positioned so as to contact the end of the first tube defining the outlet. This solution is particularly advantageous since it makes it possible to cut the powders exiting from the first tube and to obtain more precise dosing of the product exiting from the screw conveyor. Due to the high degree of compacting and/or the depression inside the first tube, a part of the powders exiting from the first tube remains anchored to it and does not detach by gravity. Through the cutting means, it is thus possible to extremely precisely cut the amount of compacted powder to be inserted inside the package arranged at the outlet of the first tube. Furthermore, due to the fact that the powders are cut through the rotation of the rotatable terminal, the aforementioned solution makes it possible to avoid using cutting means to be positioned externally which would just occupy much more space. Moreover, in view of the fact that the rotatable terminal is positioned in such a way so as to contact the end of the first tube, it is effectively possible to have a very stable cutting system because, in the case where, for example, the first tube is subjected to vibrations due to the rotation of the screw conveyor, having a contact between the two elements prevents the damage that would occur if the two elements hit each other. Another advantage consists of being able to define a continuous path of the powders without them being dispersed. In fact, in the case, for example, in which the rotatable terminal would be provided with an opening, the powders leaving the first tube would go directly inside the opening of the rotatable terminal without being mistakenly conveyed towards the outside in correspondence with the space between the outlet of the first tube and the rotatable terminal.

According to a further embodiment of the present invention, a system for packaging powders is provided in which the first tube is arranged inside a second tube; wherein the second tube is rotatable about the first tube; wherein the rotatable terminal is connected to the second tube so as to be able to rotate with it. This makes it possible to control the rotation of the rotatable terminal, and thus of the cutting means contained inside it through the rotation of the second tube. This solution is particularly advantageous since it makes it possible to adjust the rotation of the cutting means at any point of the second tube. Therefore, in this way it is possible to adjust the rotation in a position also distant from the cutting means and thus not disturbing the cutting means. Moreover, the second tube can be replaced by any other structure capable of connecting the rotatable terminal with the upper flange, like, for example, a grid. A further alternative is represented by a system of rods capable of mechanically connecting the rotatable terminal with the upper flange.

According to a further embodiment of the present invention, a system for packaging powders is provided in which the first tube and the second tube are concentric. This solution is advantageous since it makes it possible to have a particularly compact system as it is formed by two concentric tubes, as stated above.

According to a further embodiment of the present invention, a system for packaging powders is provided in which the cutting means are a plurality of wires arranged like a fan. This solution is particularly advantageous since it allows the compacted powders to be cut by carrying out a rotation of the rotatable terminal and in the same way there is no need to make the rotatable terminal go back to the starting position after having carried out said cutting.

According to a further embodiment of the present invention, a system for packaging powders is provided in which the center of the fan coincides with the axis of the first tube. This solution is particularly advantageous since it makes it possible to have a symmetrical cut and thus to have cutting means that occupy an amount of space that can be reduced to the point of having a diameter equal to the diameter of the first tube.

According to a further embodiment of the present invention, a system for packaging powders is provided in which the rotatable terminal comprises a ring structure which is preferably detachably connected to the second tube so as to be able to rotate therewith, wherein cutting means are fixed to the ring structure. This solution is particularly advantageous since it allows having a rotatable terminal which can preferably be replaced according to the user's needs. Furthermore, the fact that it can be detached and replaced enables unnecessary disassembly of the second tube each time the rotatable terminal is to be replaced. Furthermore, the ring structure allows having a particularly stable cutting structure.

According to a further embodiment of the present invention, a system for packaging powders is provided that further comprises a vertical packager comprising a forming tube configured so as to receive a film coming from a reel; the forming tube internally contains the first tube. This solution is particularly advantageous since it makes it possible to obtain a system for packaging powders having both a high packaging speed, due to the vertical packager, and a high precision in the dosing of the powders exiting from the first tube due to the cutting means.

According to a further embodiment of the present invention, a system for packaging powders is provided in which the first tube and the forming tube are concentric. This solution is particularly advantageous since it makes it possible to have a system of packaging compacted powders having three concentric tubes and therefore symmetrical and particularly compact. Such a system is both capable of cutting the powders effectively and of conveying the aforementioned powders inside packages made through such a vertical packager.

According to a further embodiment of the present invention, a system for packaging powders is provided in which the rotatable terminal comprises an inner opening concentric with the first tube so as to convey the powders through the opening; wherein the cutting means are positioned inside the opening. This solution makes it possible to have cutting means around which the compacted powders are conveyed. This also makes it possible to have cutting means in direct contact with the compacted powders and thus makes it possible to effectively cut said powders. Moreover, this solution also makes it possible to rule out the need of using cutting means to be positioned externally and thus occupy more space.

According to a further embodiment of the present invention, a system for packaging powders is provided in which the inner opening of the rotatable terminal has a maximum diameter equal to the inner diameter of said first tube.

According to a further embodiment of the present invention, a system for packaging powders is provided in which the inner opening of the rotatable terminal is cylindrical in shape, wherein the axis of the cylinder coincides with the axis of the screw conveyor. This solution has the advantage of having a constant section through which the compacted powders are conveyed, thus not having problems of obstruction.

According to a further embodiment of the present invention, a system for packaging powders is provided in which the inner opening of the rotatable terminal is frusto-conical in shape; wherein the axis of the cone coincides with the axis of the screw conveyor. This solution makes it possible to reduce the passage section of the compacted powders and thus to direct them towards the center of the cone.

According to a further embodiment of the present invention, a system for packaging powders is provided in which the inner opening of the rotatable terminal has a diameter at the outlet of the first tube equal to the inner diameter of the first tube at the outlet. This solution is particularly advantageous since by combining the fact that the rotatable terminal is in contact with the outlet of the first tube and the fact that the diameter of the pipe at the outlet is equal to the inner diameter of the opening of the rotatable terminal, it is effectively possible to have an effective conveying of the powders inside the rotatable terminal without causing neither an obstruction nor a dispersion of powders. In fact, in the case in which there would have been a larger diameter of the opening, it would somehow have resulted in a dispersion of the powders. On the other hand, in the case in which there would have been a smaller diameter of the opening, there would have been an obstruction of the conveying of the powders due to the step that would have been formed between the outlet of the tube and the opening of the rotatable terminal.

According to a further embodiment of the present invention, a system for packaging powders is provided comprising a forming tube which contains the second tube; wherein the forming tube has at least one opening configured so as to be able to blow gas inside the gap between the forming tube and the second tube. Such a solution has two particular advantages: the first concerns the possibility of compensating for the depression inside the package preventing possible damage to it, and the second advantage concerns the possibility of cooling the tubes by introducing particularly cold gas. The introduction of particularly cold gas is particularly advantageous because the temperature inside the packaging system tends to increase due to the friction exerted by the compacted powders with the screw conveyor and the inner wall of the first tube.

According to a further embodiment of the present invention, a system for packaging powders is provided in which the opening, which is configured so as to be able to blow gas inside the gap between the forming tube and the second tube, is positioned close to the upper edge of the forming tube. This provision is particularly advantageous since it makes it possible not to hamper the unwinding of the reel on the outer surface of the forming tube.

According to a further embodiment of the invention, a method is provided for packaging compacted powders in a system which conveys powders through a first tube towards the outlet of the first tube; this method includes the following step:

a) cutting of the compacted powders going out from the first tube through the rotation of a rotatable terminal comprising internal cutting means and positioned in the proximity of the outlet.

This method is particularly advantageous in that it allows cutting the powders leaving the first tube and obtaining a more precise dosage of the product exiting the screw conveyor. Due to the high degree of compaction and/or the depression inside the first tube, part of the powders leaving the first tube remains anchored to it and does not come off by gravity. By means of cutting means, it is therefore possible to cut with extreme precision the amount of compacted powder to be inserted into the package placed at the outlet of the first tube. Moreover, in view of the fact that the powders are cut directly at the outlet of the first tube, it is possible to cut the powders directly at the outlet of the first tube without the risk of dispersing the powders in any way. In fact, if the powders were cut at a certain distance from the first tube, they could be partially conveyed towards the outside and could be somehow dispersed.

According to a further embodiment of the present invention, a method is provided wherein during step a) the rotatable terminal is in direct contact with the end of the first tube which defines the outlet. This solution is particularly advantageous because the fact that the rotatable terminal is rotated so as to contact the end of the first tube, it is actually possible to have a very stable cutting system. For example, in the case where the first tube is subjected to vibrations due to the rotation of the screw conveyor, having a contact between the two elements allows to prevent the damage that would occur if the two elements hit each other. Another advantage consists in being able to define a continuous path of the powders without them being dispersed. In fact, in the case, for example, in which the rotatable terminal is provided with an opening, the powders leaving the first tube would go directly inside the opening of the rotatable terminal without being able, for example, to be mistakenly conveyed towards the outside in correspondence of a gap between the outlet of the first tube and the rotatable terminal.

According to a further embodiment of the present invention, a method is provided for packaging compacted powders in which the rotation of the rotatable terminal is provided by the rotation of a second tube around its own axis, wherein the first tube is contained in the second tube; wherein the rotatable terminal is connected to the second tube. This allows controlling the rotation of the rotatable terminal, and therefore of the cutting means contained therein, by rotating the second tube. This solution is particularly advantageous in that it allows controlling the rotation of the cutting means at any point of said second tube. Therefore, it is possible in this way to adjust the rotation in a position away from the cutting means and therefore not disturbing the cutting means.

According to a further embodiment of the present invention, a method is provided for the packaging of compacted powders which further comprises a step of forming containers by means of a vertical packaging machine so as to convey the compacted powders inside the containers; wherein the vertical packaging machine comprises a forming tube around which a film coming from a reel is received. This solution is particularly advantageous in that it allows obtaining a powder packaging method having both a high packaging speed due to the vertical packaging machine and a high precision in the dosage of the powders leaving the first tube due to the cutting means.

According to a further embodiment of the present invention, a method for packaging compacted powders is provided which further comprises a step for injecting gas into the gap formed between the forming tube and the second tube through an opening of the forming tube in order to compensate for the internal depression of the containers. This solution has two particular advantages: the first concerns the possibility of compensating the depression inside the package and preventing possible damage to the same, the second advantage regards the possibility of cooling the pipes by introducing particularly cold gas.

According to a further embodiment of the present invention, a method is provided for packaging compacted powders in which the injected gas is an inert gas, for example, nitrogen. This allows inserting inert gas that does not deteriorate the product and therefore to have packs containing very small quantities of oxygen. In this way, the organoleptic properties of the packaged product are maintained for a long time.

According to a further embodiment of the present invention, a method is provided for packaging compacted powders in which the rotatable terminal is rotated by an angle greater than or equal to the angular distance between two cutting means.

According to a further embodiment of the present invention, a method is provided for the packaging of compacted powders in which the filling step of a package is carried out simultaneously with the cutting step of the previously filled package.

BRIEF DESCRIPTION OF THE FIGURES

The present invention will be described with reference to the attached figures in which the same reference numerals and/or marks indicate the same parts and/or similar and/or corresponding parts of the system.

DETAILED DESCRIPTION

Hereinafter, the present invention is described with reference to particular embodiments, as illustrated in the attached tables of drawings. However, the present invention is not limited to the particular embodiments described in the following detailed description and represented in the figures, but rather the described embodiments simply exemplify the various aspects of the present invention, the purpose of which is defined by the claims. Further modifications and variations of the present invention will become clear to those skilled in the art.

Figure 1:
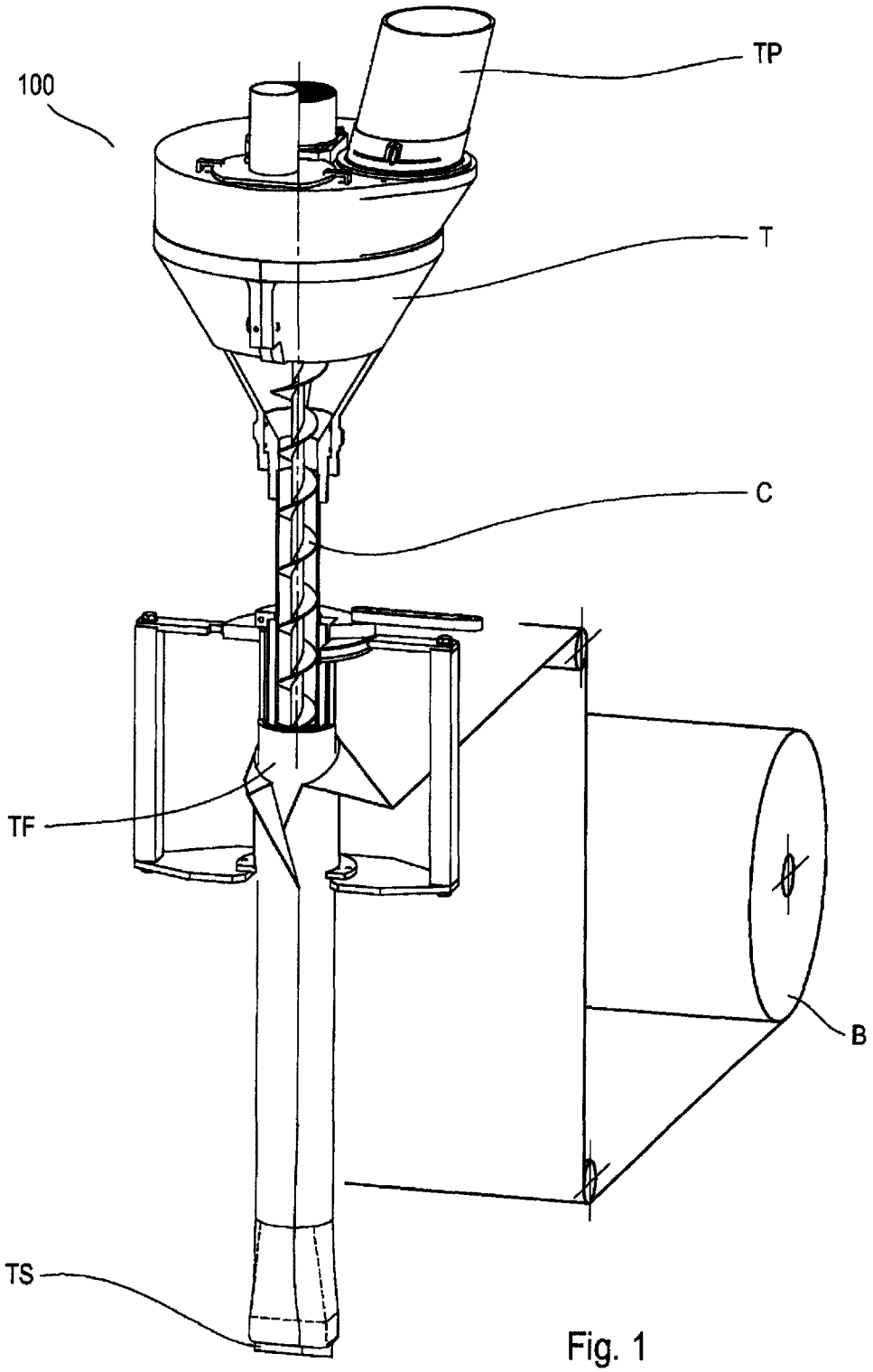
FIG. 1 schematically shows a system for packaging compacted powders in three-dimensional view according to an embodiment of the present invention.

FIG. 1 schematically shows a system for packaging compacted powders 100 according to an embodiment of the present invention. As shown in the figure, the powder packaging system 100 comprises a hopper T having an inlet TP through which powders are conveyed inside the hopper T. In the lower part of the hopper T is placed a screw conveyor C which, due to the rotation around its own axis ac, conveys the powders inside a tube positioned in the lower part of the hopper T and through which the powders are conveyed.

Figure 2:
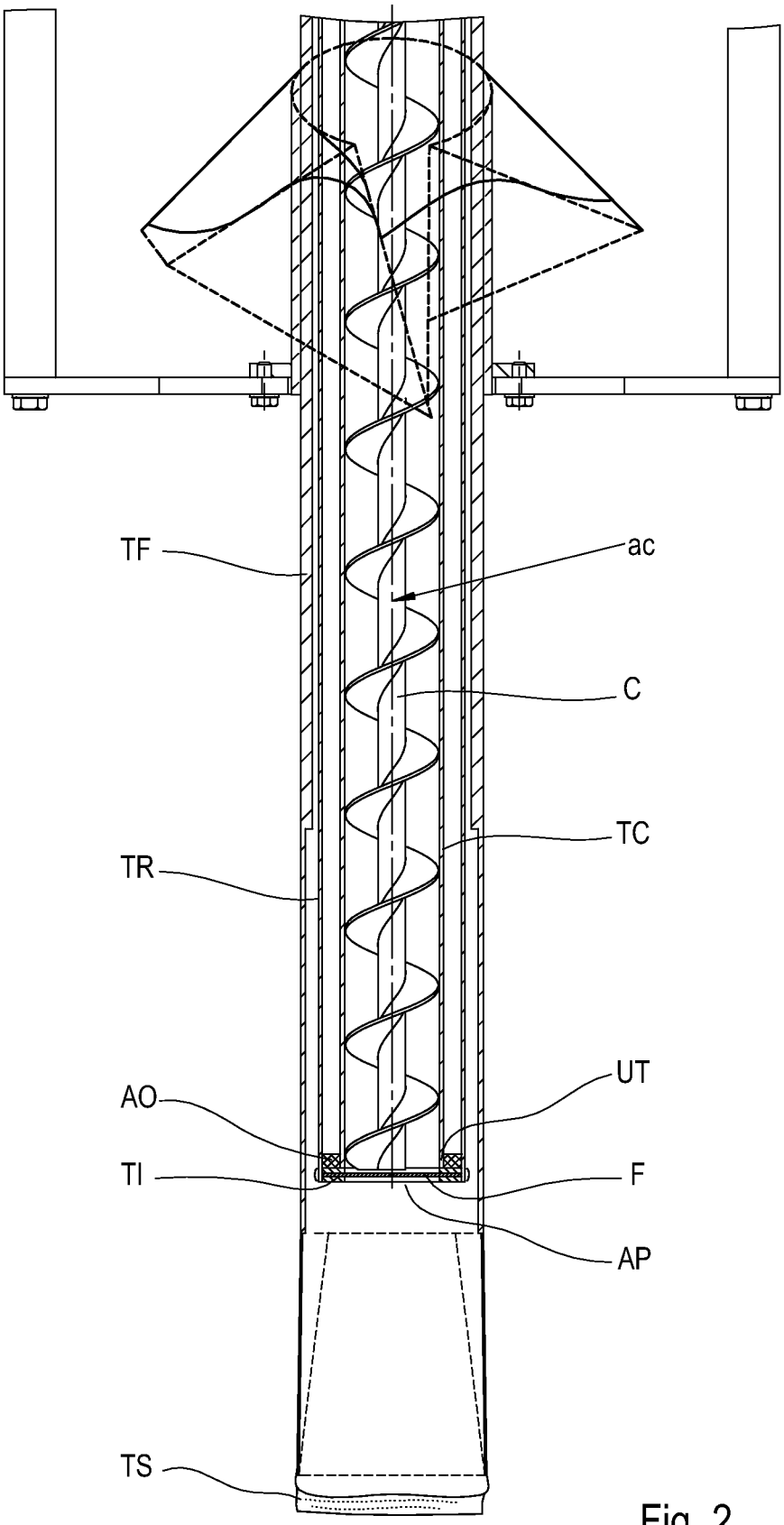
FIG. 2 schematically shows the cross-section of a powder packaging system according to an embodiment of the present invention.

FIG. 2 schematically shows a section of the lower part of the compacted powder packaging system 100 presented in FIG. 1. The screw conveyor C is contained inside a first TC tube through which the powders coming from the hopper T reach the outlet of the first tube TC. Near the output UT of the first tube TC there is a rotatable terminal T1 which comprises cutting means F.

The rotatable terminal T1, which is cylindrical in shape, comprises a concentric inner opening AP with the first TC tube so as to convey the powders through it. Furthermore, the cutting means F are positioned inside said opening AP.

Figure 3:
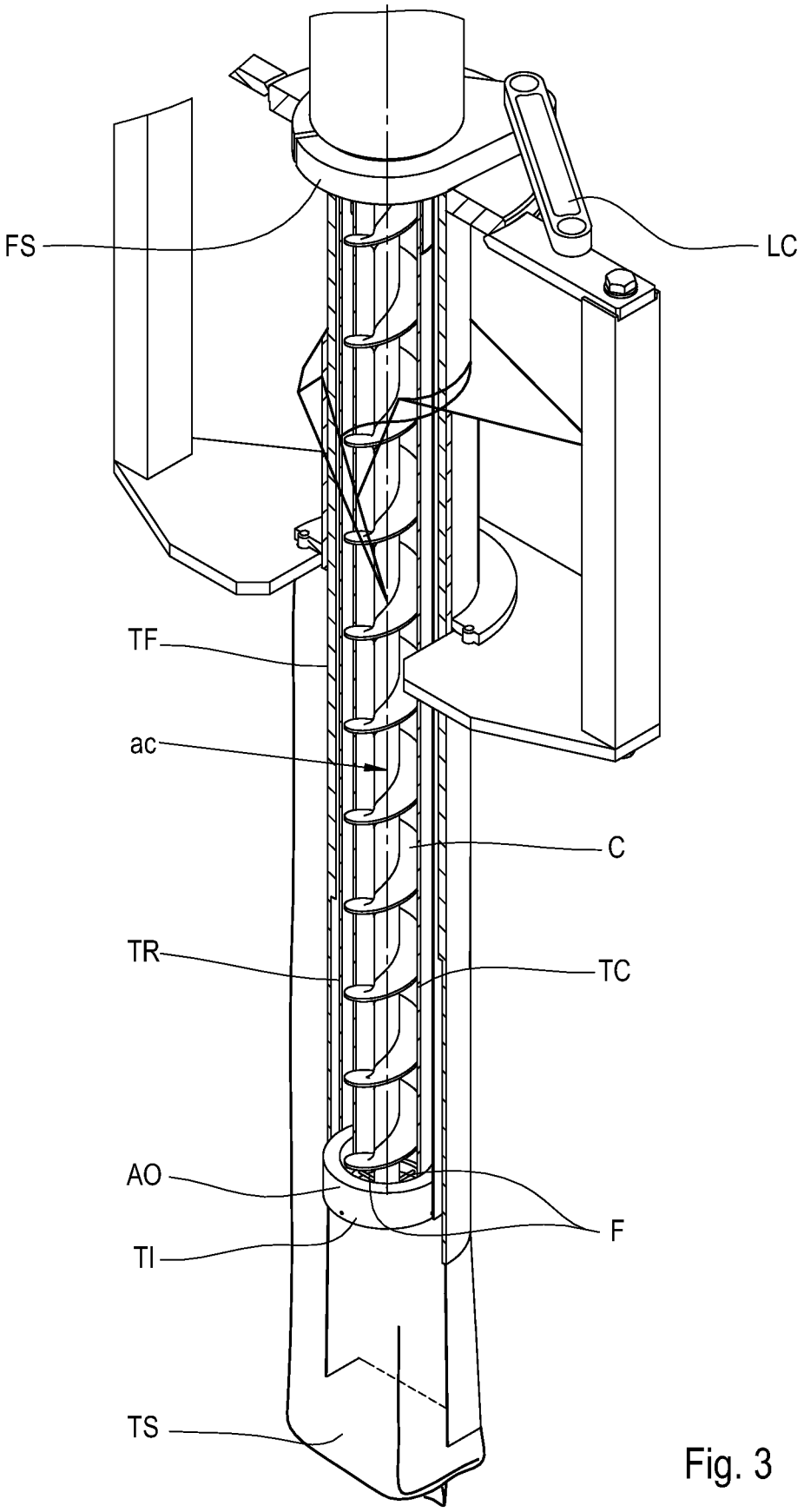
FIG. 3 schematically shows a system for packaging compacted powders in three-dimensional view according to an embodiment of the present invention.

The first TC tube is inserted inside a second tube TR. In this way, a gap is formed between the outer region of the first tube TC and the inner region of the second tube TR. The second tube TR is rotatable around the first tube TC. This rotation is guaranteed, as shown in FIG. 3, by a lever LC which is connected to an upper flange FS positioned in the upper part of the second tube TR. The second tube TR is connected to the rotatable terminal T1 so as to transmit the rotation to the terminal T1. This connection is guaranteed, for example, by a mechanical constraint.

The axes of the first tube TC and of the second tube TR coincide. Between the first tube TC and the second tube TR, a centring ring AO is positioned which ensures that the second tube TR is always centered with respect to the first tube TC. Such an element can be made, for example, of plastic, brass or bronze material which has reduced friction coefficient in order to help sliding between the tubes.

The cutting means F, represented in FIG. 3, are represented by two wires arranged perpendicular to one another in a fan so as to form an angle of 90° between them. In this way, by rotating such cutting means F by 90° the same starting configuration is obtained since a wire will have taken the place occupied by the other wire before the rotation. Moreover, the number of wires, their section and the dimensions are selected as a function of the type of powder to be dosed and of the degree of compacting of such a powder. For example, the cutting means F can also be made up of 5, 6 or even more wires. In the case in which there are four wires, the resulting angle between one wire and the other will be 45°. Such wires can be replaced, for example, by blades or by knives that are installed in an analogous manner to the wires. The wires are made from a strong material suitable for contact with food products like, for example, stainless steel. Moreover, it is also possible to use a food-grade plastic like fishing line which makes it possible to have very low thicknesses and despite this have great mechanical strength.

The cutting means F can also be formed from a grid having a plurality of openings. In this way, it is thus possible to have cutting means F consisting of multiple wires arranged woven together and forming a plurality of openings having any shape and size.

In the manufacturing step, the cutting means F can also be made by removal of material from a lower terminal TI initially without cavities. In this case, through mechanical processing, it is possible to remove material so as to form the wires in this case having a square section.

The center of the fan of wires coincides with the axis of the first tube TC and thus consequently with the axis of the screw conveyor ac. The system thus obtained, as described having central symmetry, has cutting means positioned at the center of the first tube TC.

As can be seen in FIGS. 4*a*-4*e*, which schematically show different versions of the rotatable terminal according to various embodiments of the present invention, the rotatable terminal is positioned in contact with the outlet of the first tube TC so that there is no space between the outlet of the first tube TC and the rotatable terminal TI in which the powders can be inserted. In this way, the powders going out from the first tube TC will be conveyed directly into the rotatable terminal TI. In this way, the cutting means F of the rotatable terminal will directly cut the powders leaving the first tube TC.

Moreover, as can be seen in FIGS. 4*a*-4*e*, the rotatable terminal has a ring structure to which the cutting means are fixed. The opening AP of the ring of the rotatable terminal has, in each of the examples shown, an upper diameter (that is, the diameter of the opening AP at the outlet of the first tube TC) equal to the diameter of the first tube TC at the outlet. This therefore allows the powders leaving the first TC tube to be conveyed inside the rotatable terminal without obstacles. In fact, in the case where, for example, the upper diameter of the opening AP of the rotatable terminal is smaller, it would form a step that would hinder the conveyance of the powders.

Figure 4A:
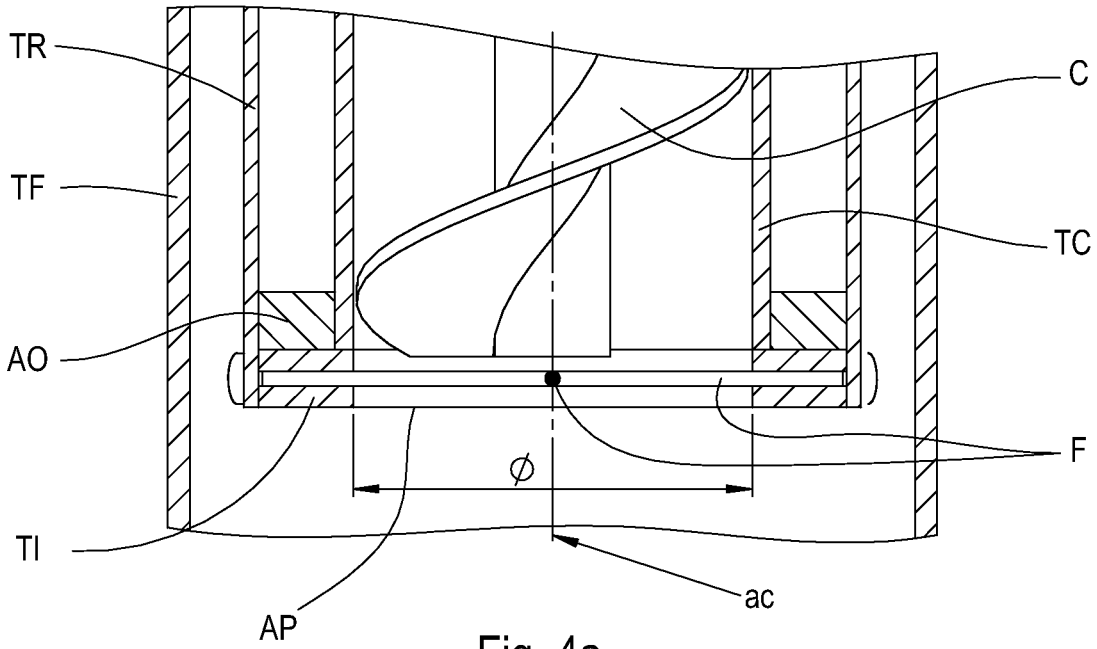
FIG. 4 *a, b, c, d*, and *e* schematically show different versions of the rotatable terminal according to various embodiments of the present invention.

The opening AP of the rotatable terminal TI, as shown in FIG. 4*a*, has a cylindrical shape, thus having a constant section along the vertical axis. Such a constant section has a diameter equal to the inner diameter of the first tube TC. According to the solution represented in the figures, the length of the first tube TC is less than that of the second tube TR. Between the end part of the second tube TR and the end part of the first tube TC, the rotatable terminal is installed that is fixed to the second tube TR. Alternatively, as represented in FIG. 4*c* the length of the two tubes can be the same and the rotatable terminal TI' can be installed below the lower edge of the two tubes.

Figure 4B:
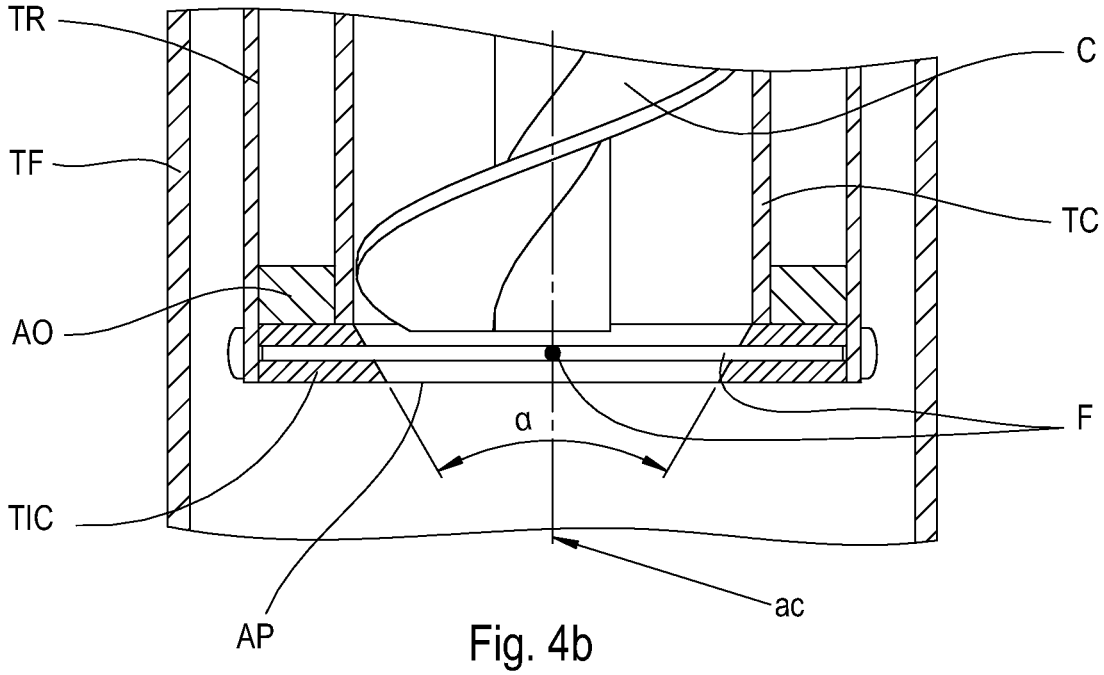
Figure 4C:
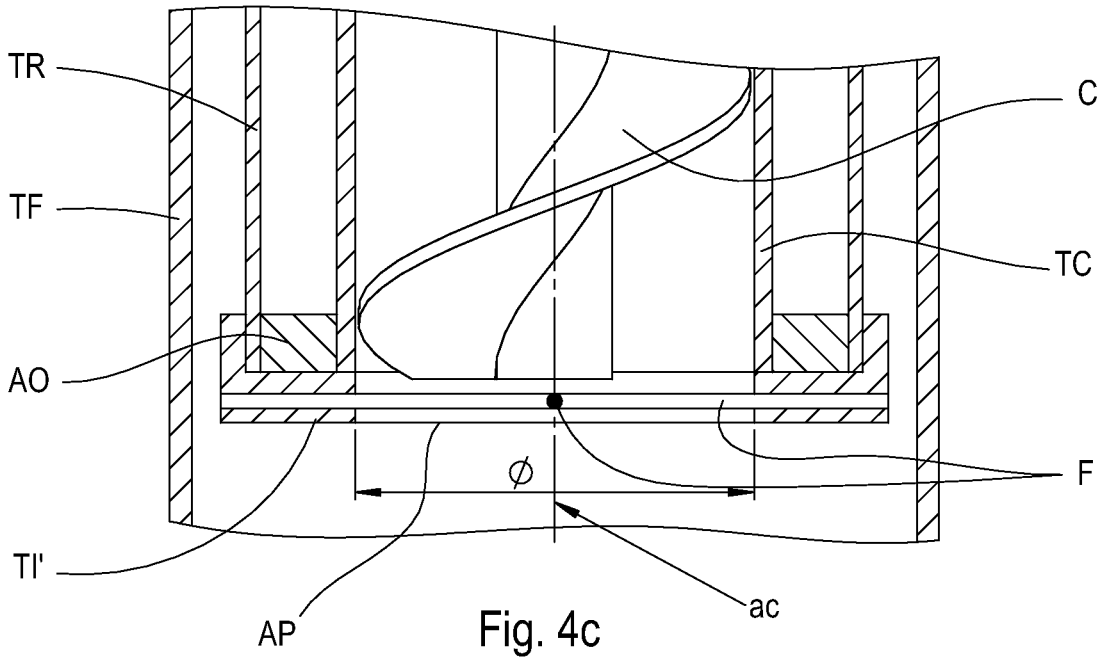
Figure 4D:
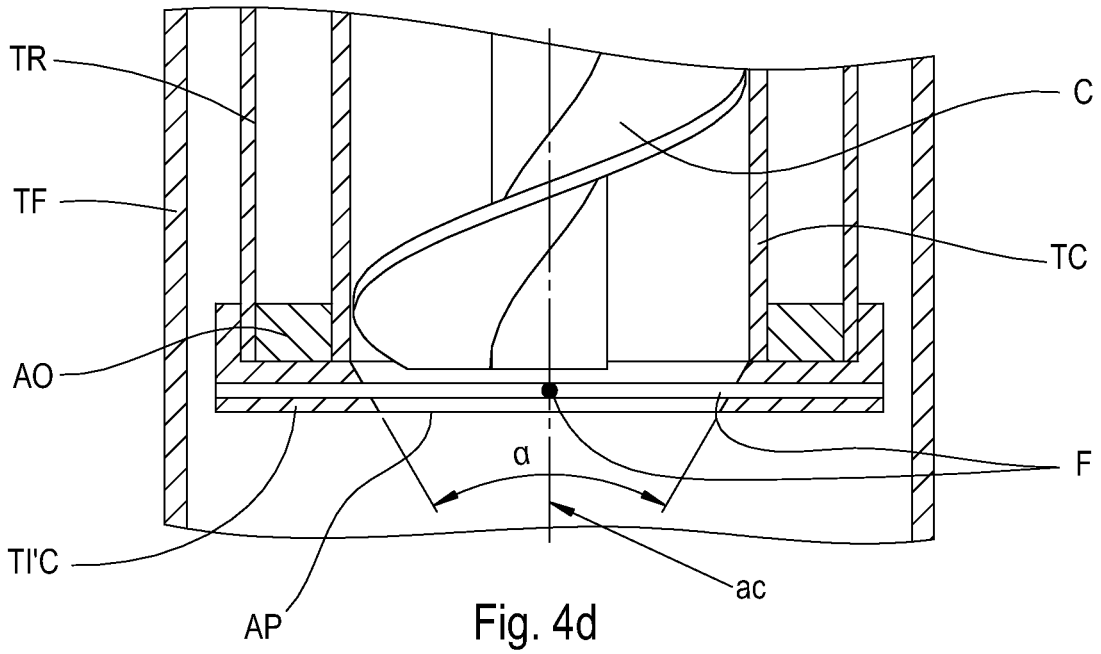

Alternatively, the opening AP of the rotatable terminal TIC, as shown in FIG. 4*b*, has a frusto-conical shape, thus having a converging section along the vertical axis: the upper part close to the outlet of the first tube TC has a diameter equal to the inner diameter of the first tube TC whereas the lower part has a smaller diameter than the upper part. The opening angle α of the cone can be adjusted depending on the degree of compacting and the type of material to be conveyed. According to the solution represented in the figures, the length of the first tube TC is less than that of the second tube TR. Between the end part of the second tube TR and the end part of the first tube TC the rotatable terminal TI is installed which is fixed to the second tube TR. Alternatively, as represented in FIG. 4*d*, the length of the two tubes can be the same and the rotatable terminal TI'C can be installed below the lower edge of the two tubes. The frusto-conical shape of the opening AP of the rotatable terminal TI'C is advantageous since it makes it possible to further compact the powder to be dosed even in the horizontal direction, in particular contributing to eliminating the possible central cavity in the volume of powder compacted due to the central region of the screw conveyor. Moreover, the frusto-conical shape makes it possible to facilitate the alignment between the product and the package to be filled.

Figure 4E:
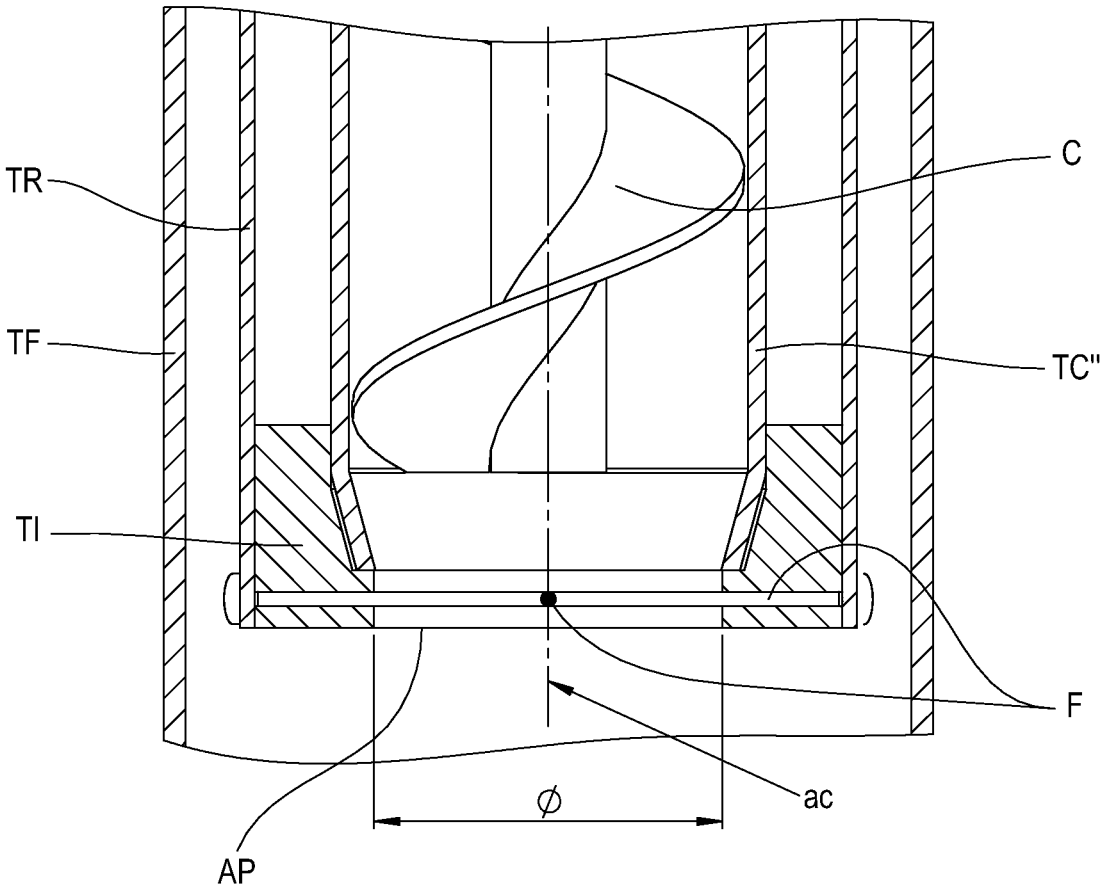

A further variant, shown in FIG. 4*e*, makes it possible to combine the advantages described above of having a cylindrical opening with those of having a conical opening. As shown in the figures, the first tube TC is in this case replaced by a first tube TC" having a frusto-conical shape at its lower end. Therefore, with such a frusto-conical portion, it is in this way possible to obtain a further compacting of the powders as described above. Downstream of said conical portion, there is the rotatable terminal TI having an opening AP that has a cylindrical shape. In this case, the rotatable terminal TI is integrated directly in the centring ring AO, so as to form a single element.

As shown in FIG. 1, the packaging system 100 further comprises a vertical packager which comprises a forming tube TF to make it possible to receive a film coming from a reel B. Like all vertical packagers, also in this case, there is a vertical welder (not represented in FIG. 1) that allows the vertical welding of the packages and there are members (not present in FIG. 1) capable of making the film slide towards the lower part of the forming tube TF. The forming tube TF internally contains the second tube TR and consequently also the first tube TC. Therefore, a gap is thus formed between the second tube TR and the forming tube TF. Moreover, the axis of the forming tube TF coincides with the axis of the first tube TC.

Figure 12:
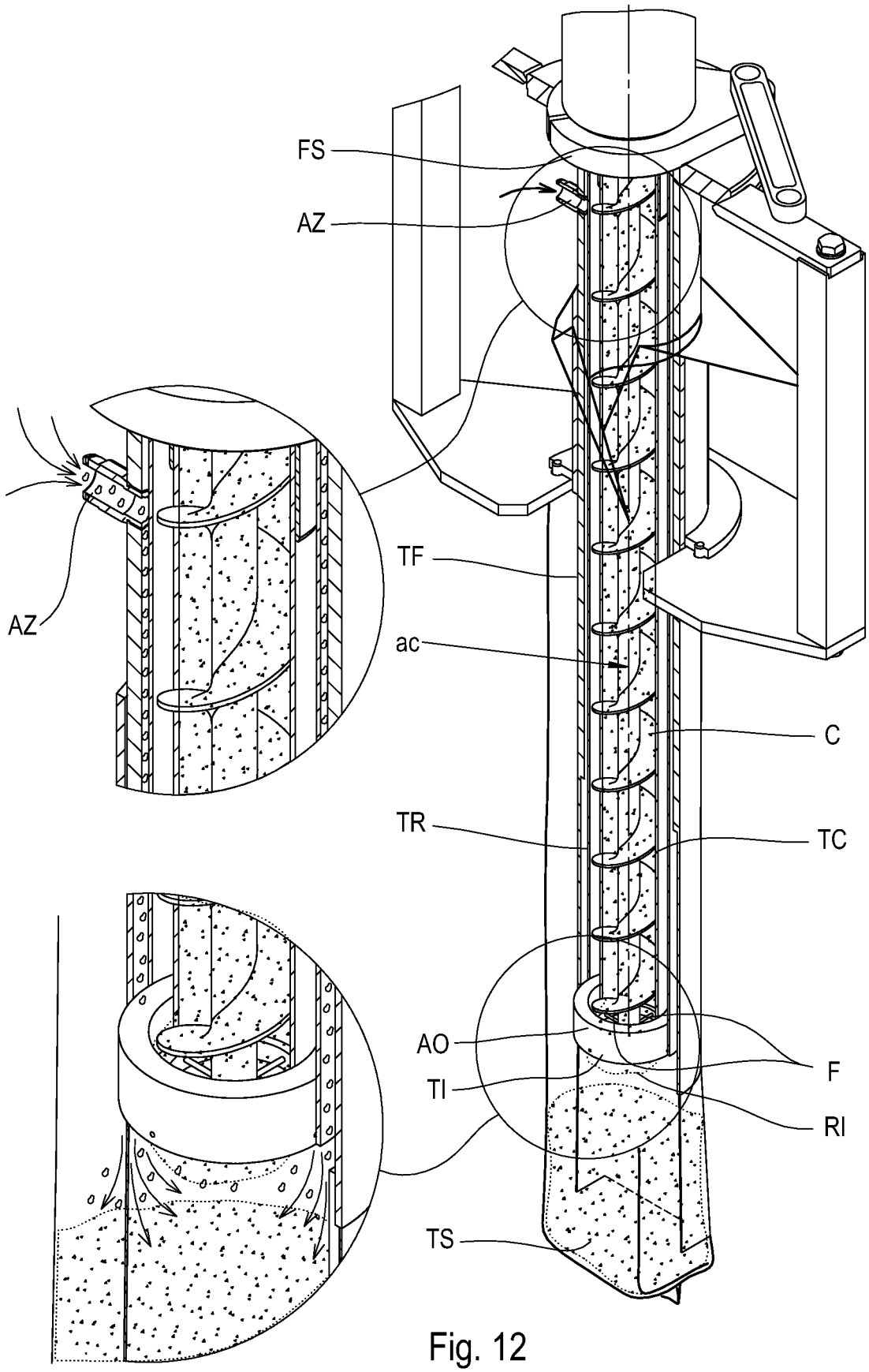
FIG. 12 shows a three-dimensional view of the opening of the forming tube and the introduction of gas inside it according to an embodiment of the present invention.

As shown in FIG. 12, in the upper part of the forming tube TF, there is at least one opening AZ from which gas can be introduced inside the gap formed between the forming tube TF and the second tube TR. In addition or alternatively, an opening (not represented in the figures) can also be made on the outer upper surface of the second tube TR, for example, above the upper flange FS.

Moreover, the second tube TR can be replaced by any other structure capable of connecting the rotatable terminal TI with the upper flange FS, like, for example, a grid. In this case the two aforementioned gaps will communicate. An alternative is represented by a system of rods capable of mechanically connecting the rotatable terminal TI with the upper flange FS or by a tube machined inside it.

Hereinafter, with reference to FIGS. 5 to 12, the operative steps of the system shown in FIG. 3 are described and a method for packaging powders based on a particular embodiment of the present, invention is thus described.

Figure 5:
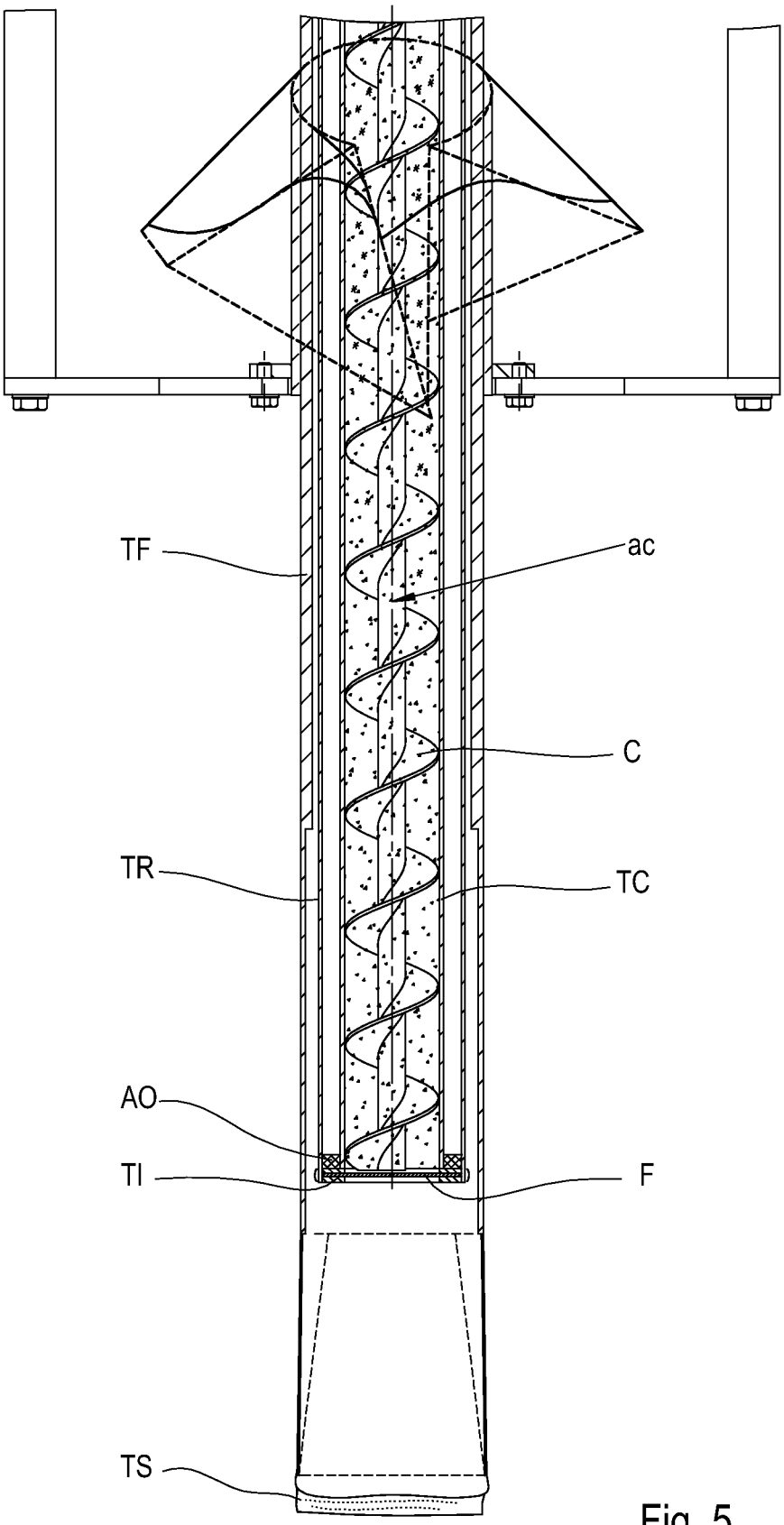
FIG. 5 schematically shows the cross-section of a powder packaging system at the moment when the plant is filled with powders according to an embodiment of the present invention.

FIG. 5 represents the initial step of feeding the first tube TC with the compacted powders. The vertical packager slides the film coming from the reel B downwards, welded longitudinally and arranged on the outer surface of the forming tube TF. Such a film slides to the outlet of the forming tube TF so as to form a tubular element TS that in a second step, after filling a welding closed, will form the package. As shown in the figures, the tubular element TS is welded at the bottom and such a process will however be described hereinafter.

Figure 6:
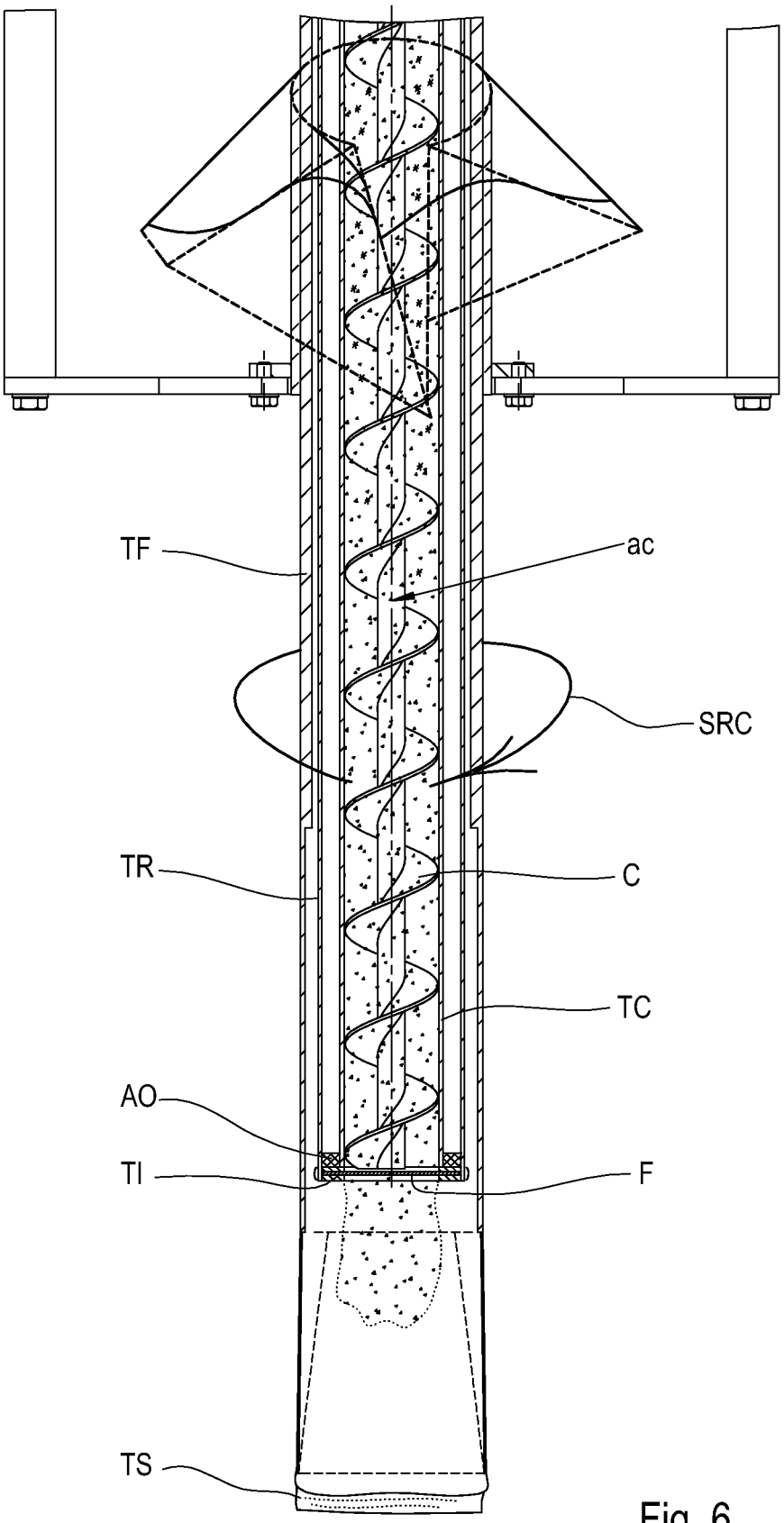
FIG. 6 schematically shows the initial phase of filling a package in a powder packaging system according to an embodiment of the present invention.

In a subsequent step, depicted in FIG. 6, the volumetric dosing of the screw conveyor C takes place. By rotating around its axis ac, it makes the required volumetric amount of compacted powders reach the tubular element. Since the powders are compacted homogeneously, the amount by weight of compacted powders arriving at the tubular element is therefore also known. In this step, as described earlier and as represented in the figures, there is only the movement of the screw conveyor C around its axis ac in the direction SRC represented in the figures, whereas all of the other moving members are stationary.

Figure 7:
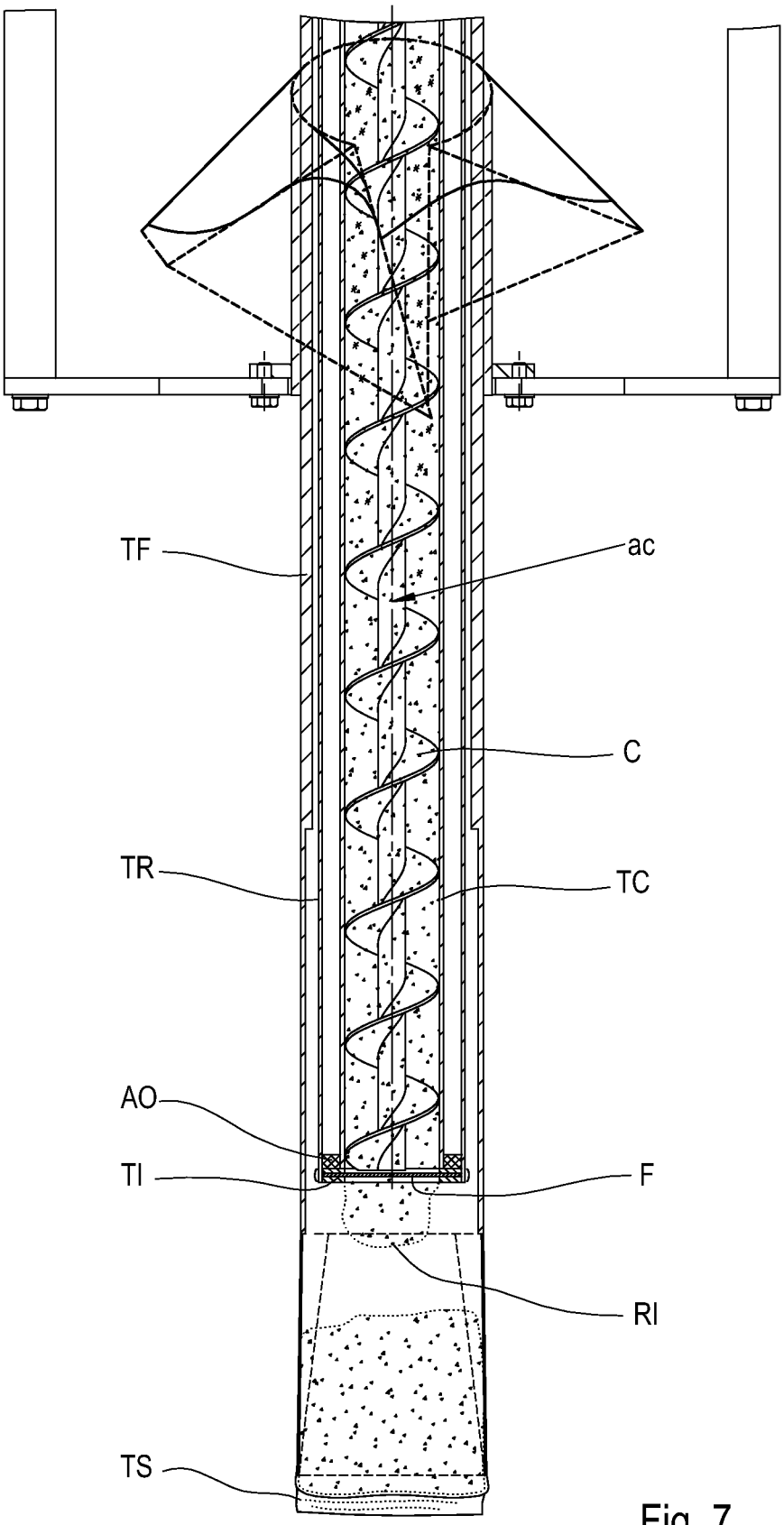
FIG. 7 schematically shows the step of stopping the screw conveyor in a semi-filled package status in a powder packaging system according to an embodiment of the present invention.

In a subsequent step, represented in FIG. 7, after the required flow rate of compacted powders has reached the tubular element TS, the stopping of the screw conveyor C takes place. However, due to the high degree of compacting and/or due to the vacuum present inside the first tube TC a part RI of the compacted powders remains anchored to it and does not detach by gravity. The vacuum present inside the first tube TC is due to the fact that for the compacting of the powders, the air contained inside the powders is extracted thus forming a large depression area. Such a remainder RI can represent a significant weighing error in filling. Such an error is accentuated more for smaller packages.

Figure 8:
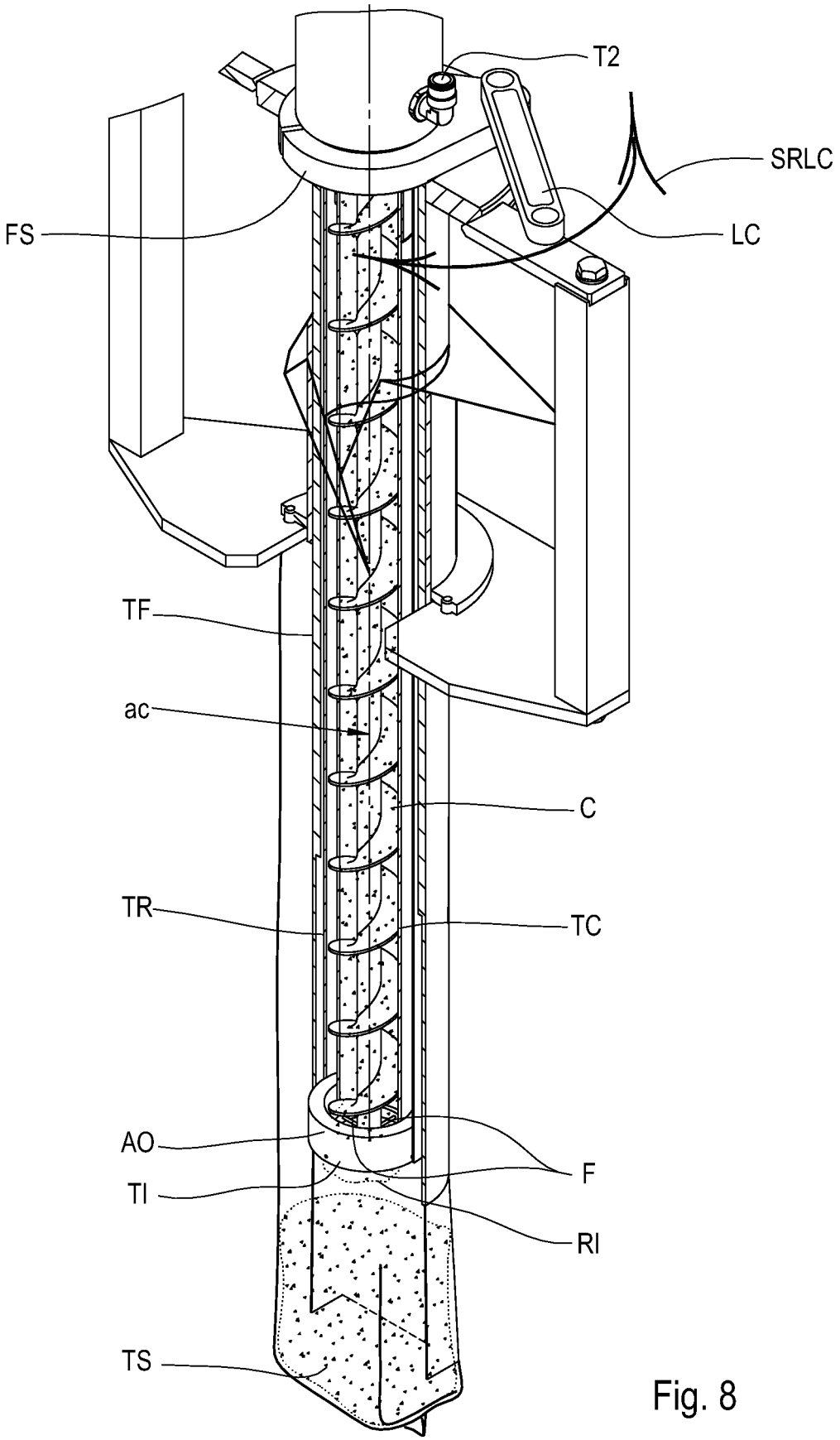
FIG. 8 shows a three-dimensional view of the step of stopping the screw conveyor in the semi-filled package status in a powder packaging system according to an embodiment of the present invention.

For this reason, it becomes necessary to cut the remainder RI of the compacted powders still anchored to the outlet. Therefore, as shown in FIG. 8, through the movement of the lever LC along the direction SRLC, it is possible to move the upper flange FS of the second tube TR so as to allow the second tube TR to rotate about its axis. The degrees by which the second tube TR is rotated depend on the number of wires or blades of the cutting means F used. Indeed, in order to cut the remainder RI effectively, it is necessary to rotate the cutting members F by an angle greater than or equal to the angular distance between two wires. In the case, for example, in which it concerns a single wire, the rotation will be equal to 180°, in the case of two wires the rotation will be equal to 90°, in the case of four wires it will be equal to 45°, and so on. As described previously the number of wires is dependent on the type of powders and on the degree of compacting and it can be changed depending on which materials are being used.

In the embodiment depicted, the lever LC allows the rotation of the flange FS in both directions: clockwise and anti-clockwise. Therefore, in the case depicted it is possible, once cutting has been carried out, to return to the starting position. It is obvious to those skilled in the art that in the case in which it is wished to avoid the step of returning to the starting position the lever LC can be replaced with a system that allows the upper flange FS to rotate 360° like, for example, gear, rack or similar systems.

Figure 9:
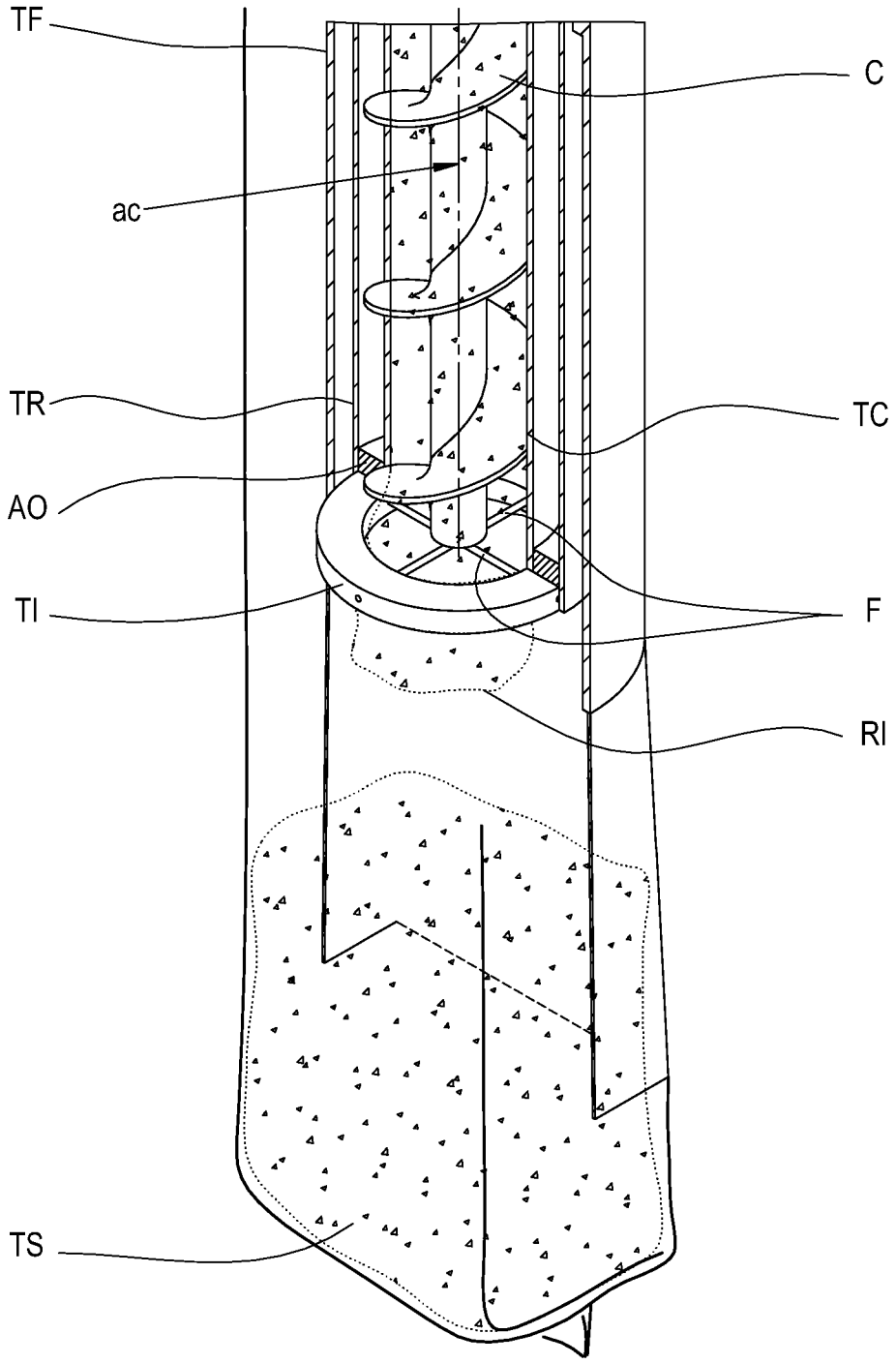
FIG. 9 is a three-dimensional view of stopping the screw conveyor in the semi-filled package status in a powder packaging system according to an embodiment of the present invention.
Figure 10:
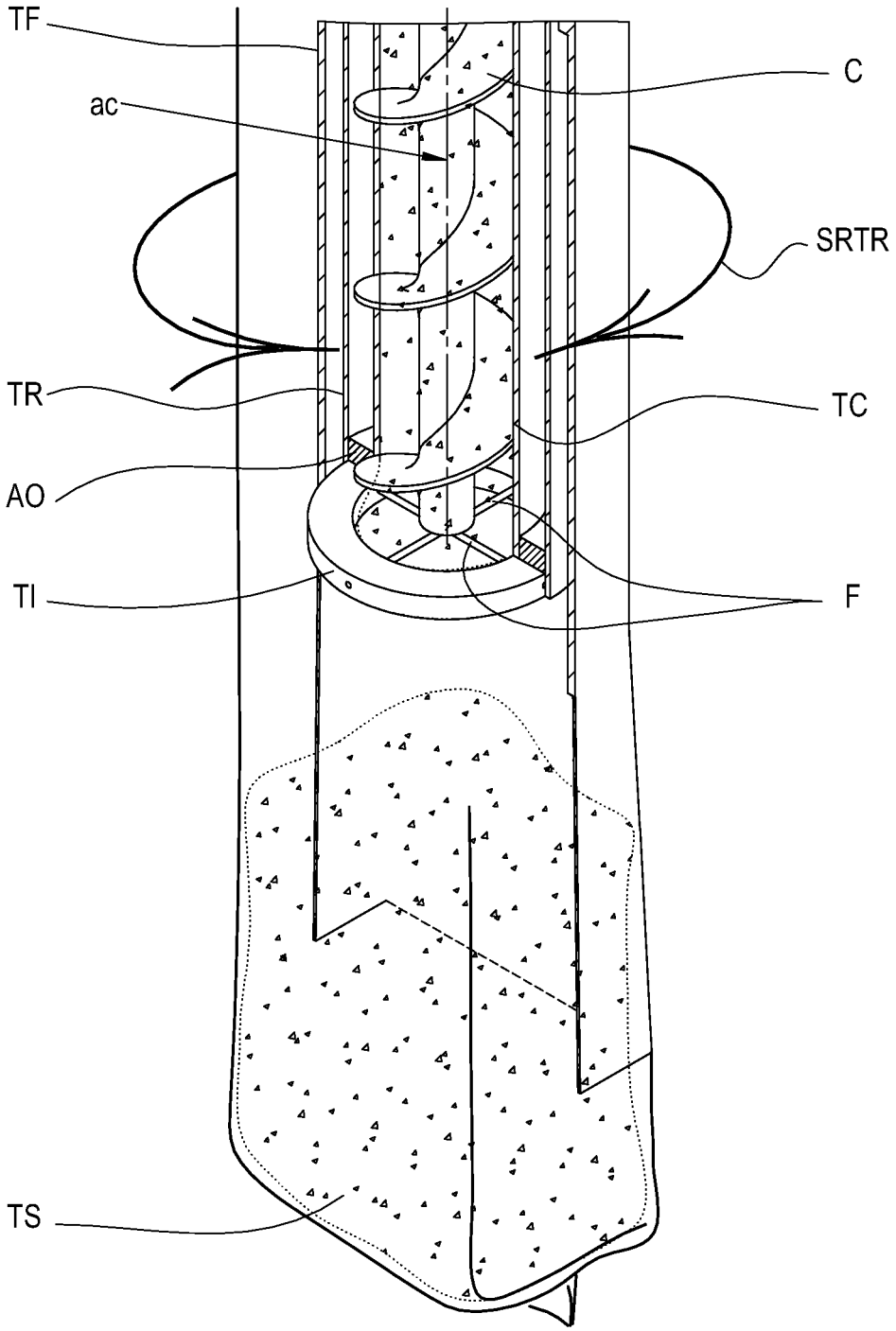
FIG. 10 shows a three-dimensional view of the rotation phase of the second tube to which the rotatable terminal is fixed according to an embodiment of the present invention.
Figure 11:
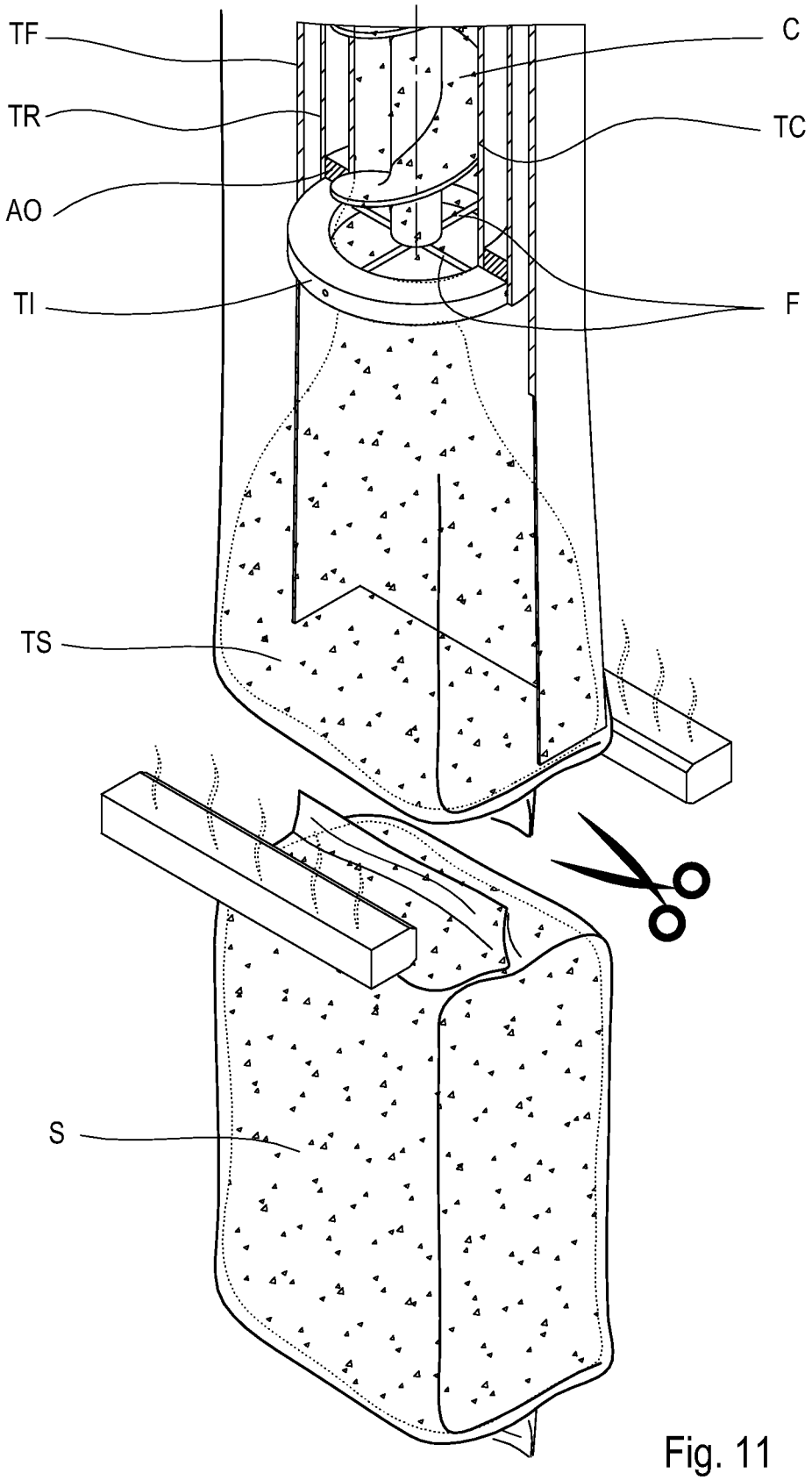
FIG. 11 shows a three-dimensional view of the completion of the package by welding and shearing and the beginning of the filling of a new package according to an embodiment of the present invention.

FIG. 9 represents a detail of the remainder RI still anchored to the outlet of the first tube. Following the rotation by 90° of the second tube TR (represented in FIG. 10) and thus consequently the rotation of the rotatable terminal TI having cutting means F made up of two wires, the remainder is driven inside the tubular element TS so that the required amount of compacted powders is conveyed inside the tubular element TS.

In the case described above, following the cutting process, the second tube TR is brought back into the position where it was before the rotation discussed above. Alternatively, it is also possible to proceed with a rotation in a first direction, then carry out the dosing step through the rotation of the screw conveyor C, and thereafter take the rotatable terminal TI to its original position by carrying out a second rotation in the opposite direction with respect to the first, represented by arrow SRTR illustrated in FIG. 10. In this way, the cutting would be carried out in the return step of the rotatable terminal TI. Therefore, the rotatable terminal TI will in this case be equipped with blades directed so as to be able to cut in the return step in the case in which blades have been selected as cutting means F. On the other hand, in the case in which they are cutting means F represented by wires, in this case, there is not the problem of the cutting direction since they can be used without distinction in both of the cutting directions.

At this point, the tubular element TS is ready to be closed. Therefore, in a subsequent step, depicted in FIG. 11, the closing of the upper part of the tubular element TS takes place through welding, and therefore there is the formation of a package S. In carrying out the welding at the same time, both the lower part of the new tubular element TS is closed and the upper part of the old tubular element TS is closed, thus forming a package S. After the welding has been carried out, the package produced can be separated from the tubular element TS through shearing. Following the welding process and before the shearing process is carried out, it is already possible to fill the next tubular element TS since, as stated previously, with the welding the lower closure of the new tubular element TS is prepared. In particular, said processes can also be carried out simultaneously.

As shown in FIG. 12, in order to make it possible to compensate for the depression contained inside the tubular element TS, it is possible to insert gas inside the gap formed between the second tube TR and the forming tube TF. In this way, it is thus possible to compensate for the air that is drawn from inside the tubular element TS through the various tubes. The compensation is particularly important for the formation of the tubular element TS, since expanding outwards, it draws air inside it through the tubes with which it is placed in communication. In the absence of such compensation, the package S could therefore be ruined.

Moreover, in the case in which it is intended to prevent the contact of the compacted powders (which therefore have previously been removed of much of the air contained inside them) with an oxygen-rich atmosphere, it is possible to introduce inert gas, like, for example, nitrogen inside the opening AZ of the forming tube. In the case, for example, in which coffee is being handled, this solution is particularly advantageous since it is well known that it would be harmful for the coffee to be in contact with an oxygen-rich atmosphere, since the coffee could oxidise.

The amount of gas to be inserted inside the opening AZ is adjusted according to what depression is created inside the tubular element TS during the unwinding step. Such a depression can indeed be different depending on the format of the package to be made and on the type of film used. Such adjustment can, for example, be carried out by means of a valve.

Even if the present invention has been described with reference to the embodiments described above, it is clear to those skilled in the art that it is possible to make different modifications, variations and improvements to the present invention in light of the teaching described above and in the attached claims, without departing from the object and the scope of protection of the invention.

For example, the shape of the rotatable terminal is not necessarily round. Similarly, the shape of the tubes is not necessarily round. Moreover, the step of cutting the package is not constrained to being carried out through mechanical shearing since it could, for example, be carried out by laser cutting.

The method and the system for packaging powders described in the present invention makes it possible to package any type of powdered material in any field. An example of powdered material that can be packaged is flour or ground coffee, and more generally any type of powdered material present in the food industry. Another example is represented by powders used in the building trade, for example, lime. The first tube can, for example, be interchangeable so as to be able to be replaced to change the filtering fineness in the case in which there are big variations in the grain size of the powder to be packaged.

Finally, fields that are deemed known by those skilled in the art have not been described in order to avoid needlessly excessively overshadowing the described invention.

Consequently, the invention is not limited to the embodiments described above, but is only limited by the scope of protection of the attached claims.

What is claimed is:

1. A compacted powders packaging system, comprising:

a first tube, wherein said first tube comprises a screw conveyor configured to rotate about an axis inside said first tube so as to convey powders towards an outlet of said first tube, wherein said system comprises a rotatable terminal in proximity to said outlet; said rotatable terminal comprising internal cutting means configured to cut compacted powders going out from said first tube when said rotatable terminal rotates, wherein said rotatable terminal is positioned so as to contact the end portion of said first tube which defines said outlet;

wherein said rotatable terminal includes an internal opening which is concentric with said first tube so as to convey the powders through said internal opening;

wherein said internal cutting means are positioned within said internal opening;

wherein said internal opening has a diameter at said outlet of said first tube which is equal to the inner diameter of said first tube at said outlet; and wherein said internal opening of said rotatable terminal is of conical or truncated cone shape; wherein an axis of said conical or truncated cone shape coincides with the axis of said screw conveyor.

2. The compacted powders packing system according to claim 1, wherein:

said first tube is placed inside a second tube;

wherein said second tube is rotatable around said first tube; and wherein said rotatable terminal is connected to said second tube so as to rotate with said second tube.

3. The compacted powders packing system according to claim 2, wherein:

said first tube and said second tube are concentric.

4. The compacted powders packing system according to claim 2, wherein:

said rotatable terminal comprises a ring structure, which is detachably connected to said second tube so as to be able to rotate with said second tube, wherein said cutting means are connected to said ring structure.

5. The compacted powders packing system according to claim 1, wherein:

said cutting means comprise a plurality of wires arranged in a radial pattern.

6. The compacted powders packing system according to claim 5, wherein:

the center of said radial pattern coincides with the axis of said first tube.

7. The compacted powders packing system according to claim 1, further comprising:

a vertical packaging machine comprising a forming tube configured to accommodate a film coming from a reel;

wherein said forming tube contains said first tube inside said forming tube.

8. The compacted powders packing system according to claim 7, wherein:

said first tube and said forming tube are concentric.

9. The compacted powders packing system according to claim 2, further comprising:

a forming tube containing said first tube; wherein said forming tube has an opening configured to insufflate gas into a gap between said forming tube and said second tube.

10. The compacted powders packing system according to claim 9, wherein:

said opening is positioned in proximity to an upper edge of said forming tube.

11. The compacted powders packing system according claim 2, further comprising:

a vertical packaging machine comprising a forming tube configured to accommodate a film coming from a reel; and wherein said forming tube contains said second tube inside said forming tube.

* * * * *